US008814295B2

(12) United States Patent
Kosugi

(10) Patent No.: US 8,814,295 B2
(45) Date of Patent: Aug. 26, 2014

(54) PRINTING APPARATUS

(71) Applicant: Seiko Epson Corporation, Tokyo (JP)

(72) Inventor: Yasuhiko Kosugi, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/975,629

(22) Filed: Aug. 26, 2013

(65) Prior Publication Data

US 2014/0063089 A1 Mar. 6, 2014

(30) Foreign Application Priority Data

Aug. 31, 2012 (JP) ..... 2012-191098

(51) Int. Cl.
*B41J 2/195* (2006.01)
*B41J 2/175* (2006.01)

(52) U.S. Cl.
CPC ..... *B41J 2/17566* (2013.01); *B41J 2/17509* (2013.01); *B41J 2/17546* (2013.01)
USPC ..... 347/7

(58) Field of Classification Search
CPC .... B41J 2/17566; B41J 2/195; B41J 2/17503; B41J 2/17526; B41J 2/17506
USPC ..... 347/5–7, 19, 84–86
See application file for complete search history.

(56) References Cited

U.S. PATENT DOCUMENTS 6,371,586 B1 * 4/2002 Saruta ..... 347/7
7,396,115 B2 * 7/2008 Tsuji ..... 347/86
8,091,997 B2 1/2012 Edwards
8,287,064 B2 * 10/2012 Akatsuka et al. ..... 347/7

FOREIGN PATENT DOCUMENTS

JP 2001-239676 9/2001
JP 2002-120375 4/2002
JP 2010-240951 10/2010

* cited by examiner

*Primary Examiner* — An Do

(57) ABSTRACT

A printing apparatus includes first to n-th (n is an integer equal to or greater than 2) ink tanks in which ink accommodated in an ink pack is filled, slots that respectively correspond to the ink tank, memory units that are packaged together with the ink pack and are respectively installed in the slots, and a processing unit that controls read-out of data from or writing of data to the memory unit. The processing unit updates total ink consumption information on the main body side for each ink color on the basis of the counted ink consumption, and writes the total ink consumption based on the total ink consumption information on the main body side, to the storage device of the memory unit corresponding to the ink color.

9 Claims, 11 Drawing Sheets

FIG. 9A

| PRESENCE OR ABSENCE OF INK WITHIN INK TANK | TOTAL INK CONSUMPTION WD ON MAIN BODY SIDE | INSTALLATION/ NON-INSTALLATION OF MEMORY UNIT | PRESENCE OR ABSENCE OF USE TERMINATION INFORMATION | EXECUTION OF PRINTING |
|---|---|---|---|---|
| PRESENCE | WD < WTH2 | NON-INSTALLATION | – | IMPOSSIBLE |
| | | INSTALLATION | ABSENCE | POSSIBLE |
| | | | PRESENCE | IMPOSSIBLE |
| | WTH2 ≤ WD < WTH3 | NON-INSTALLATION | – | POSSIBLE |
| | | INSTALLATION | ABSENCE | POSSIBLE |
| | | | PRESENCE | POSSIBLE |
| | WTH3 ≤ WD | NON-INSTALLATION | – | IMPOSSIBLE |
| | | INSTALLATION | ABSENCE | IMPOSSIBLE |
| | | | PRESENCE | IMPOSSIBLE |
| ABSENCE | – | – | – | IMPOSSIBLE |

FIG. 9B

| TOTAL INK CONSUMPTION WDM ON MEMORY SIDE | ERRONEOUS INSTALLATION OF MEMORY UNIT | REWRITING OF TOTAL INK CONSUMPTION ON MAIN BODY SIDE |
|---|---|---|
| WDM < WTH2 | NO | YES |
| | YES | NO |
| WDM ≥ WTH2 | – | NO |

PRINTING APPARATUS

BACKGROUND

1. Technical Field

The present invention relates to a printing apparatus and the like.

2. Related Art

Ink cartridges (liquid containers) used in an ink jet type printing apparatus are provided with a storage device in order to manage the total ink consumption (ink consumption) of ink that is consumed from the cartridge. In addition, in a method of filling ink in an ink tank, rather than in an ink cartridge, which is provided in a printing apparatus, ink consumption is managed by installing a memory unit including a storage device in the printing apparatus. The storage device stores information, for example, an ink color or total ink consumption. Data regarding the total ink consumption is transmitted from a printing apparatus main body to the storage device, and is written in a non-volatile memory or the like which is included in the storage device. For example, JP A-2002-120375 discloses a technique that writes data regarding the total ink consumption in a storage device every time printing is terminated.

However, the technique has a problem that when an unexpected event such as power discontinuity occurs during the printing, the total ink consumption that is counted on the main body side cannot be written in the storage device, which results in the dissociation between the total ink consumption on the main body side and the total ink consumption on the storage device side.

SUMMARY

An advantage of some aspects of the invention is to provide a printing apparatus and the like capable of managing the total ink consumption with a high reliability.

According to an aspect to the invention, there is provided a printing apparatus including a first ink tank to an n-th (n is an integer equal to or greater than 2) ink tank in which ink accommodated in an ink pack is filled; a first slot to an n-th slot that respectively correspond to the first ink tank to the n-th ink tank; a first memory unit to an n-th memory unit that are packaged together with the ink pack and are respectively installed in the first slot to the n-th slot; and a processing unit that controls read-out or writing of data with respect to the first memory unit to the n-th memory unit that are respectively installed in the first slot to the n-th slot. Each of the first memory unit to the n-th memory unit has a storage device. The processing unit executes a process of counting ink consumption for each ink color during the printing, updates total ink consumption information on the main body side for each ink color on the basis of the counted ink consumption, writes the total ink consumption based on the total ink consumption information on the main body side, with respect to the storage device of the memory unit corresponding to the ink color in the first memory unit to the n-th memory unit, every time an amount of increase in the total ink consumption based on the total ink consumption information on the main body side exceeds a first threshold value, writes the total ink consumption in the storage device of the memory unit when the total ink consumption exceeds a second threshold value for defining the termination of use of the memory unit even in a case where the amount of increase in the total ink consumption does not exceed the first threshold value, and writes use termination information indicating that the use of the memory unit is terminated, in the storage device.

According to the aspect of the invention, a writing process may be executed with respect to the storage device every time the total ink consumption increases by the first threshold value, and thus the number of writing processes may be suppressed. In this manner, the destruction of data due to a write error of the storage device may be suppressed. In addition, a difference between the total ink consumption written in the storage device and total ink consumption on the main body side may be set to be equal to or less than the first threshold value. In addition, the total ink consumption and the use termination information may be written in the storage device immediately after the total ink consumption exceeds the second threshold value, and thus the use of the memory unit may be reliably terminated. As a result, total ink consumption may be managed with high reliability.

In addition, in the aspect of the invention, the processing unit may not execute printing in a case where the memory unit corresponding to the ink color is not installed or in a case where the use termination information is written in the storage device of the memory unit corresponding to the ink color, when the total ink consumption based on the total ink consumption information on the main body side is less than the second threshold value.

In this case, the printing can be executed when the memory unit in which the use termination information is not written in the storage device is installed, and thus the total ink consumption can be reliably written in the storage device.

In addition, in the aspect of the invention, the processing unit may set the printing to be in an executable state even in a case where the memory unit corresponding to the ink color is not installed or a case where the use termination information is written in the storage device of the memory unit corresponding to the ink color, when the total ink consumption based on the total ink consumption information on the main body side is equal to or greater than the second threshold value and less than a third threshold value.

In this case where ink remains in the ink tank even when the total ink consumption is equal to or greater than the second threshold value, the printing can be continued using the remaining ink.

In addition, in the aspect of the invention, the second threshold value may be a value corresponding to total ink consumption that is estimated when ink corresponding to an amount of ink accommodated in the ink pack, which is packaged together with the memory unit, is consumed, in a case where ink consumption efficiency of the printing apparatus in which the memory unit is installed is a lower limit within a predetermined range.

In this case, the printing can be executed until the total ink consumption reaches the second threshold value even when the ink consumption efficiency of the printing apparatus is the lower limit within the predetermined range.

In addition, in the aspect of the invention, the processing unit may rewrite the total ink consumption information on the main body side to the same value as the total ink consumption that is written in the storage device of the memory unit, in a case where the total ink consumption written in the storage device of the memory unit is less than the second threshold value after power is applied to the printing apparatus or after any one of the first memory unit to the n-th memory unit is replaced.

In this case, the total ink consumption written in the storage device and the total ink consumption on the main body side can be set to have the same value. In addition, when the ink is replenished and the memory unit is replaced, the total ink consumption information on the main body side can be rewritten to an initial value.

In addition, in the aspect of the invention, the processing unit may not rewrite the total ink consumption information on the main body side to the total ink consumption that is written in the storage device of the memory unit, in a case where the total ink consumption written in the storage device of the memory unit is equal to or greater than the second threshold value.

In this case, the total ink consumption information on the main body side can be prevented from being rewritten to an erroneous value.

In addition, in the aspect of the invention, the processing unit may rewrite the total ink consumption information on the main body side to the same value as the total ink consumption written in the storage device of the memory unit, in a case where the memory unit is installed in the slot corresponding to the ink color of ink accommodated in the packaged ink pack in the first slot to the n-th slot.

In this case, when the memory unit is erroneously installed, the total ink consumption information on the main body side may be prevented from being rewritten to an erroneous value.

In addition, in the aspect of the invention, the storage device may store ink color information corresponding to the ink color of the packaged ink pack. The processing unit may output a read-out command to the memory unit, may determine whether ink color information that is read out on the basis of the read-out command and an ink color corresponding to the slot in which the memory unit is installed are consistent with each other, and may rewrite the total ink consumption information on the main body side to the same value as the total ink consumption written in the storage device of the memory unit when the read-out ink color information and the ink color corresponding to the slot are consistent with each other.

In this case, when the memory unit is installed in the slot corresponding to a different ink color, the processing unit can detect erroneous installation, thereby allowing the total ink consumption information on the main body side to be prevented from being rewritten to an erroneous value.

BRIEF DESCRIPTION OF THE DRAWINGS

The invention will be described with reference to the accompanying drawings, wherein like numbers reference like elements.

FIG. 9A is a diagram illustrating conditions for executing printing.

FIG. 9B is a diagram illustrating conditions for rewriting total ink consumption information on the main body side.

DESCRIPTION OF EXEMPLARY EMBODIMENTS

Hereinafter, a preferred embodiment of the invention will be described in detail. Meanwhile, the present embodiment to be described below does not unduly limit the content of the invention described in the claims, and all of the features described in the present embodiment are not necessarily essential as means to solve the invention.

1. Printing Apparatus

Figure 1:
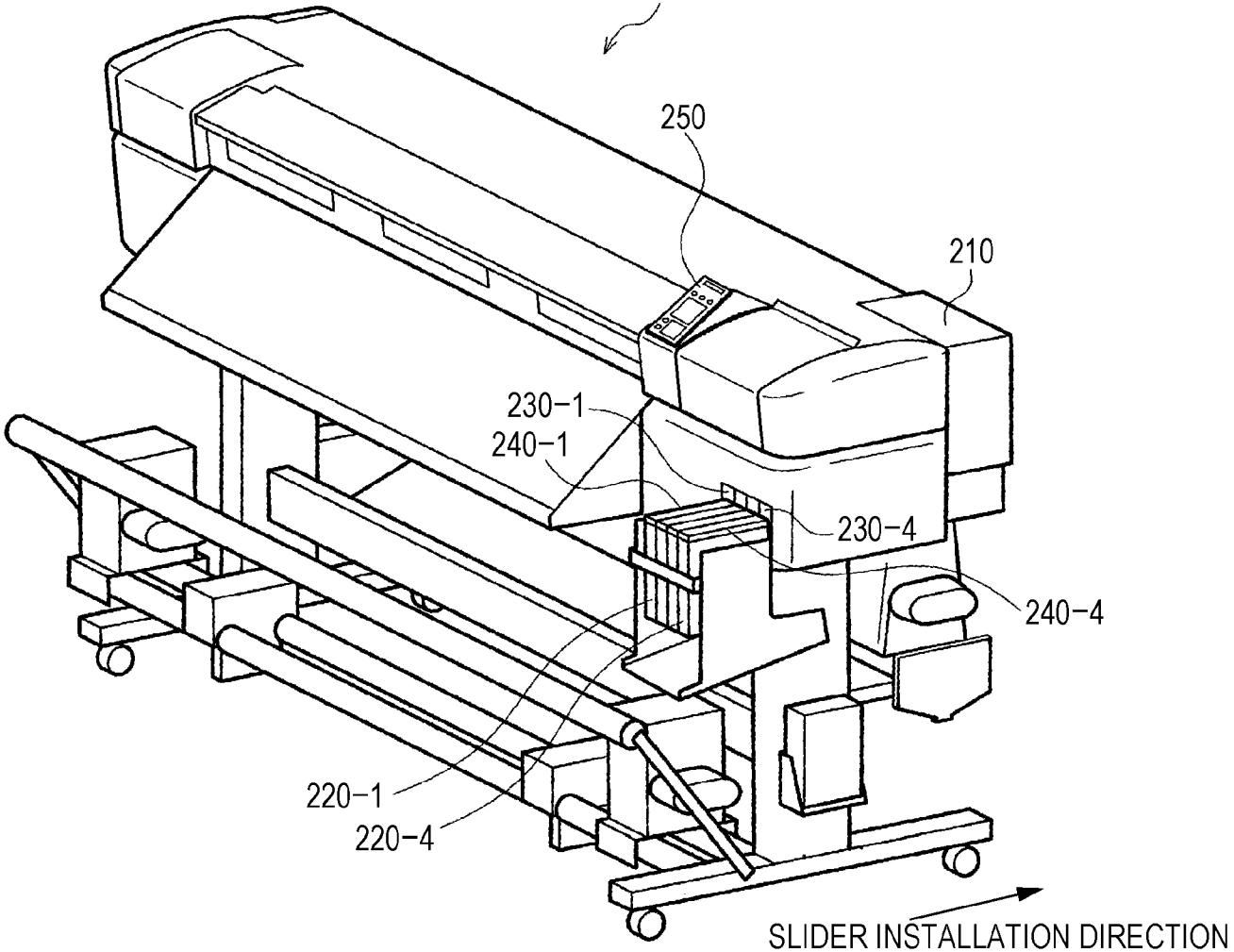
FIG. 1 is a perspective view illustrating a configuration example of a printing apparatus.

FIG. 1 is a perspective view illustrating a configuration example of a printing apparatus 200 according to the present embodiment. The printing apparatus 200 of the present embodiment includes first to n-th (n is an integer equal to or greater than 2) ink tanks 220-1 to **220-*n*, first to n-th slots 230-1 to 230-*n*, first to n-th memory units 100-1 to 100-*n*, sliders 240-1 to 240-*n*, a processing unit 210, and an operation unit 250. Meanwhile, the printing apparatus 200 of the present embodiment is not limited to the configuration illustrated in FIG. 1, and various modifications such as omission of some of its components, replacement with other components, or the addition of other components can be made. Although FIG. 1** illustrates a case of n=4, the relation of n=2 or n=3 may be established, or the relation of n≥5 may be established.

Meanwhile, in the description below, when there is no need to differentiate individual ink tanks with respect to the first to n-th ink tanks 220-1 to **220-*n*, the first to n-th ink tanks are appropriately referred to as an ink tank 220, and the same is true of the first to n-th slots 230-1 to 230-*n*, the first to n-th memory units 100-1 to 100-*n*, and the sliders 240-1 to 240-*n***.

Ink accommodated in an ink pack is filled in each of the first to n-th (n is an integer equal to or greater than 2) ink tanks 220-1 to **220-*n*. For example, a black ink is filled in the first ink tank 220-1, a yellow ink is filled in the second ink tank 220-2, a magenta ink is filled in the third ink tank 220-3, and a cyan ink is filled in the fourth ink tank 220-4. These kinds of ink are accommodated in different ink packs and are provided to a user. The user can fill (replenish) ink in the ink tank 220** corresponding to an ink color, from the ink pack of the ink color needed.

The first to n-th slots 230-1 to **230-*n* are used to install the sliders 240-1 to 240-*n* that can be attached to or detached from the printing apparatus 200 in the printing apparatus 200, and are provided so as to correspond to the first to n-th ink tanks 220-1 to 220-*n*. For example, the first to fourth slots 230-1 to 230-4 are provided on the first to fourth ink tanks 220-1 to 220-4** in which a black ink, a yellow ink, a magenta ink, and a cyan ink are respectively filled, so as to correspond to the first to fourth ink tanks, respectively.

The first to n-th memory units 100-1 to **100-*n* are packaged together with the ink pack, are provided to a user, and are respectively attached to the sliders 240-1 to 240-*n* by the user. The sliders 240-1 to 240-*n* to which the first to n-th memory units 100-1 to 100-*n* are attached are respectively installed in the first to n-th slots 230-1 to 230-*n*, and thus the memory unit 100 is installed in the slot 230. In FIG. 1, each memory unit 100 is installed in each corresponding slot 230, and thus the memory unit cannot be seen. Each of the first to n-th memory units 100-1 to 100-*n* includes a storage device 110** (not shown).

The storage device 110 previously stores common communication ID information that does not depend on an ink color of the packaged ink pack, ink color information corresponding to the ink color of the packaged ink pack, and the amount of ink filled in the packaged ink pack. For example, the storage device 110 included in the first memory unit 100-1, which is packaged together with the ink pack accommodating a black ink and is provided, previously stores the common communication ID information and the ink color information corresponding to black. The first memory unit 100-1 is then installed in the first slot 230-1. The total ink consumption information of the corresponding ink color is written by the processing unit 210, with respect to the storage device 110 of the memory unit 100 that is installed in each slot 230, in association with the execution of a printing process. The total ink consumption information is information of ink consumption rate data (a relative value) based on the amount of ink filled in the ink pack.

The sliders 240-1 to **240-*n* are respectively installed in the first to n-th slots 230-1 to 230-*n*. The k-th (k is an integer satisfying the relation of $1 \leq k \leq n$) memory unit 100-*k* in the first to n-th memory units 100-1 to 100-*n* is detachably mounted on the slider 240-*k* by a user. The slider 240-*k* on which the k-th memory unit 100-*k* is mounted is installed in the k-th slot 230-*k*, and thus the k-th memory unit 100-*k* is installed in the k-th slot 230-*k***.

The processing unit 210 includes a CPU 211, a storage unit 212, and a communication processing unit 213, and executes a printing process of the printing apparatus 200 and a communication process with each memory unit 100. Specifically, the processing unit controls read-out or writing of data with respect to the first to n-th memory units 100-1 to **100-*n* that are respectively installed in the first to n-th slots 230-1 to 230-*n*. In addition, the processing unit 210 executes a process of detecting whether the first to n-th memory units 100-1 to 100-*n* are respectively installed in the first to n-th slots 230-1 to 230-*n*. In addition, the processing unit 210 executes a process of counting the ink consumption for each ink color during the printing, and a process of calculating total ink consumption information on the main body side WD (WD1 to WDn) of each ink color on the basis of the counted ink consumption and updating the total ink consumption information on the main body side WD of its own storage unit 212. In the process of counting the ink consumption for each ink color, the ink consumption is counted, including not only counting of ink that is consumed by printing but also counting of the consumption of ink that is consumed by the maintenance of a printing head of the printing apparatus 200**.

The operation unit 250 is an input device for executing various commands or settings by a user, and includes a display unit for executing various notifications to the user.

Figure 2:
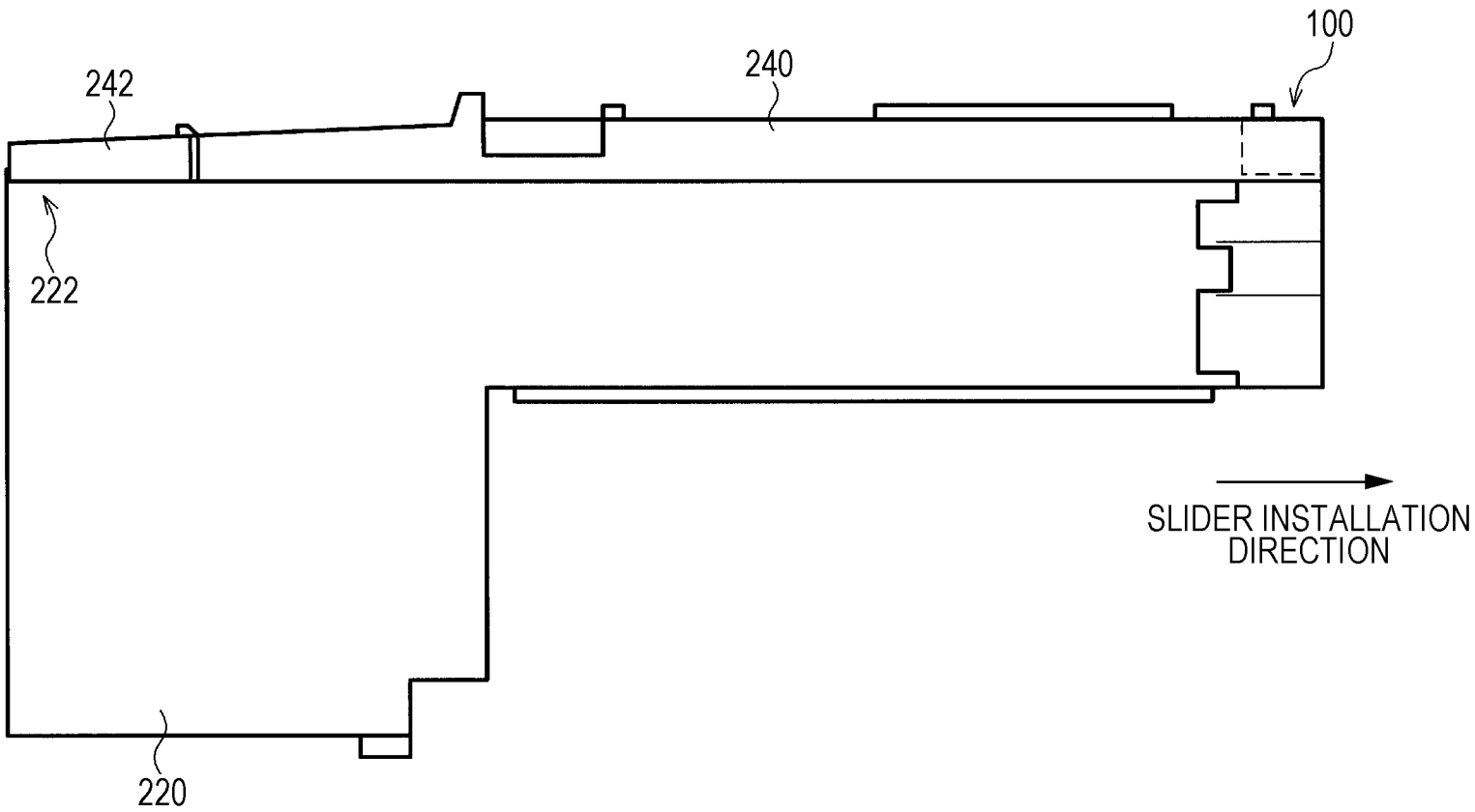
FIG. 2 is a side view illustrating a configuration example of an ink tank and a slider.

FIG. 2 is a side view illustrating a configuration example of the ink tank 220 and the slider 240 of the present embodiment. The ink tank 220 includes an ink supply port 222. A user can fill the ink accommodated in the ink pack from the ink supply port 222. The ink tank 220 is fixed to the printing apparatus 200, and the ink can be filled in a state where the ink tank is fixed to the printing apparatus. In a state where the slider 240 is installed in the slot 230, the ink can be filled in the ink tank 220 by opening an ink supply port cover 242 of the slider 240.

The slider 240 can be attached to or detached from the printing apparatus 200 by sliding on the ink tank 220. When a user installs the memory unit 100 in the slot 230, the user pulls out the slider 240 from the slot 230, mounts the memory unit 100 on a tip portion on the side toward the installation direction of the slider 240, and inserts the slider 240 again into the slot 230 along the installation direction. FIG. 2 illustrates a state where the memory unit 100 is mounted on the slider 240.

Figure 3:
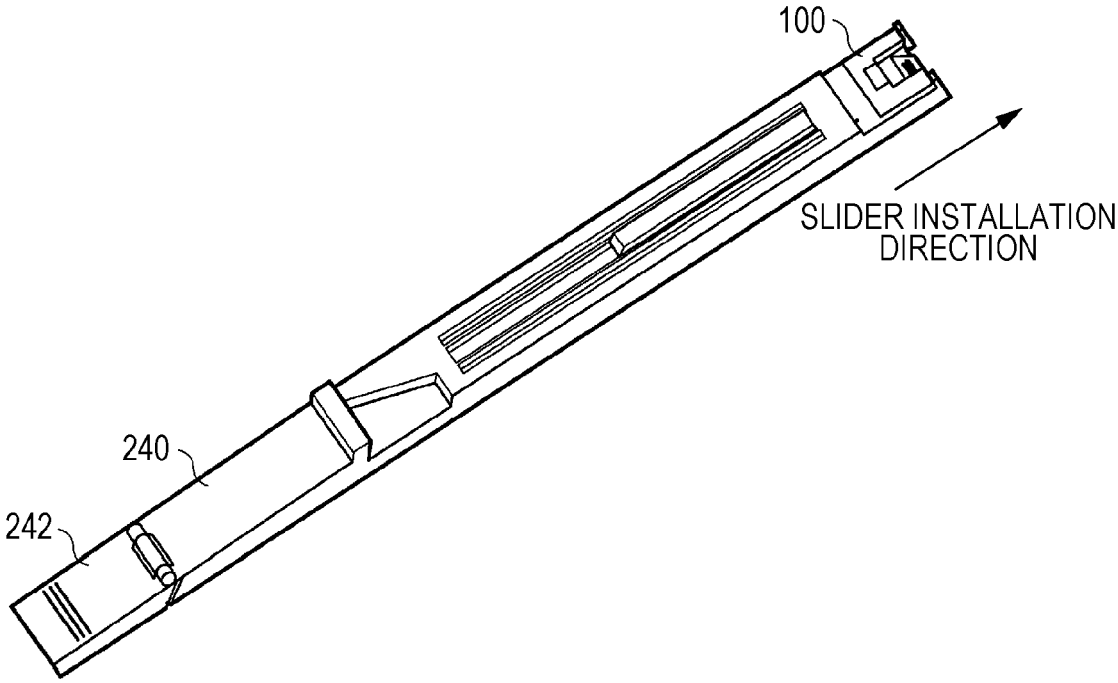
FIG. 3 illustrates a configuration example of the slider.

FIG. 3 illustrates a configuration example of the slider 240 of the present embodiment. As illustrated in FIG. 3, the memory unit 100 is mounted on the tip portion on the side toward the installation direction of the slider 240. The term "mounted" herein indicates that the memory unit 100 is placed in a predetermined place of the slider 240, and the memory unit is not required to be fixed to the predetermined place.

Figure 4:
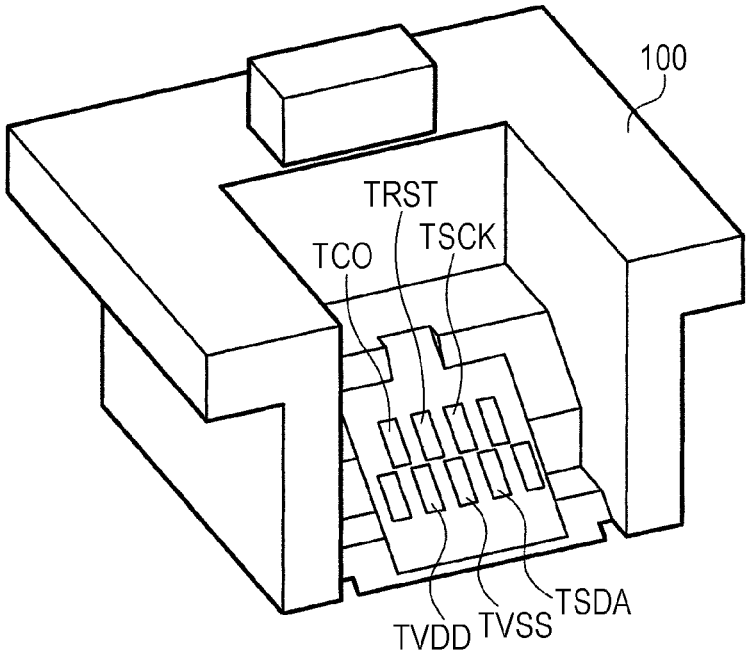
FIG. 4 illustrates a configuration example of a memory unit.

FIG. 4 illustrates a configuration example of the memory unit 100 of the present embodiment. The memory unit 100 includes the storage device 110 (not shown), a reset terminal TRST, a clock terminal TSCK, a data terminal TSDA, a first power terminal TVDD, a second power terminal TVSS, and an installation detection terminal TCO. These terminals are electrically connected to terminals on the main body side CRST, CSCK, CSDA, CVDD, CVSS and CCO of the printing apparatus 200 which are provided in the slot 230, respectively, by installing the memory unit 100 in the slot 230. Meanwhile, the reset terminal TRST, the clock terminal TSCK, the data terminal TSDA, the first power terminal TVDD, and the second power terminal TVSS are collectively referred to as a "storage device terminal". In addition, the number and arrangement of terminals are not limited to those illustrated in FIG. 4, and can vary in various ways.

Figure 5:
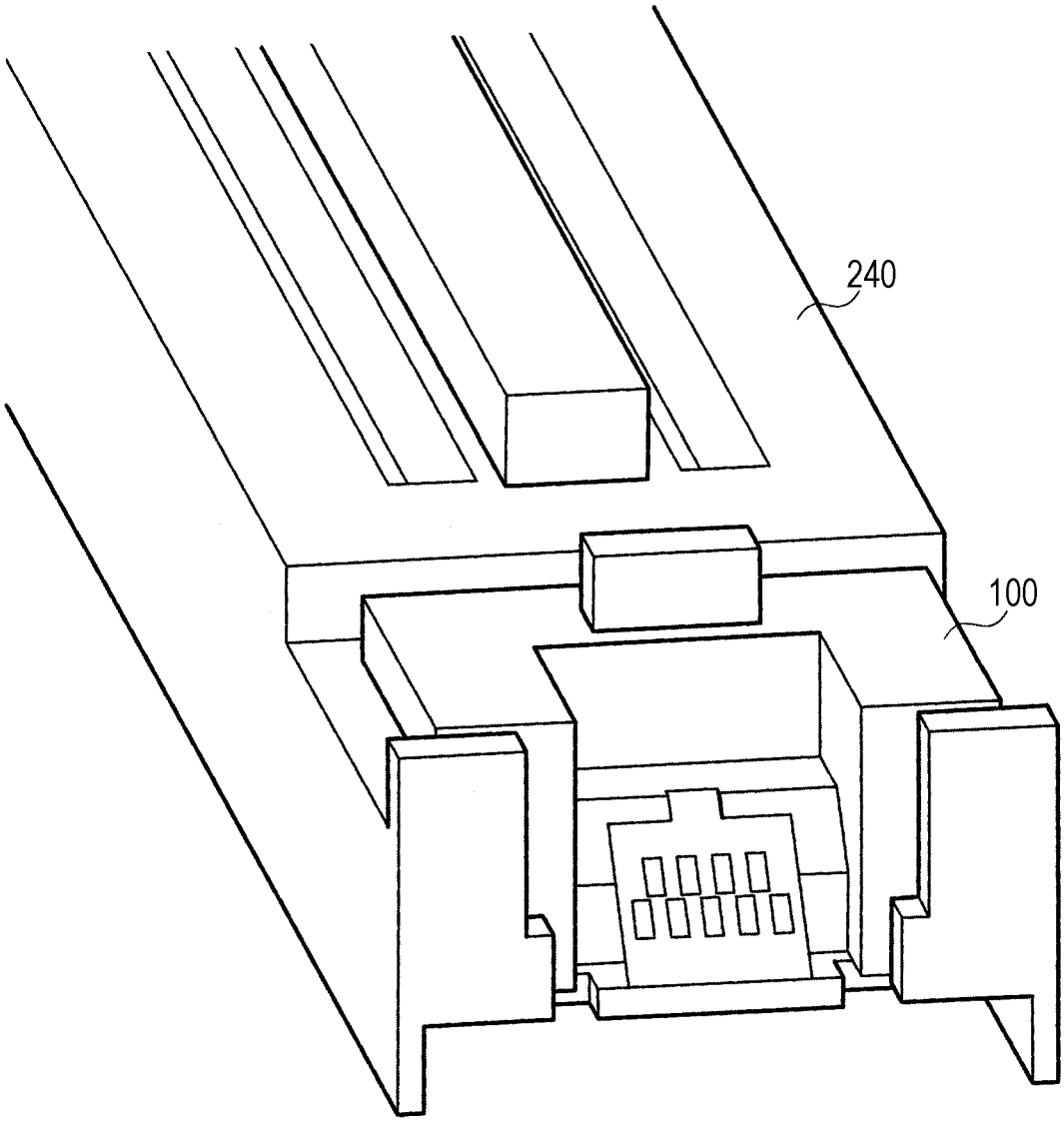
FIG. 5 illustrates a configuration example of a tip portion of the slider on which the memory unit is mounted.

FIG. 5 illustrates a configuration example of the memory unit 100 that is detachably mounted on the slider 240 of the present embodiment. As illustrated in FIG. 5, the memory unit 100 is mounted on the tip portion on the side toward the installation direction of the slider 240.

Figure 6:
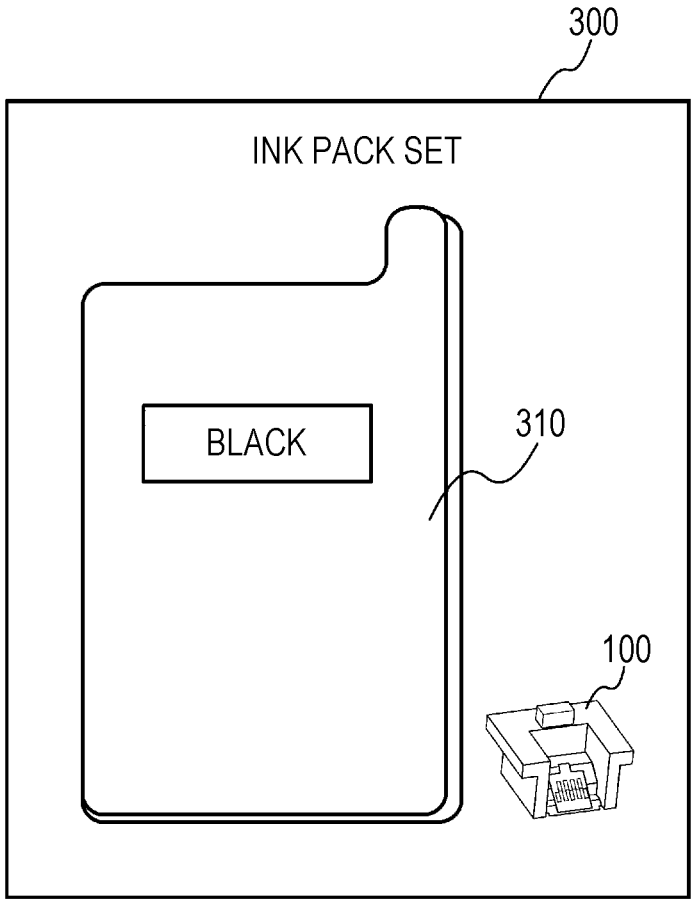
FIG. 6 illustrates a configuration example of an ink pack set.

FIG. 6 illustrates a configuration example of an ink pack set 300 of the present embodiment. The ink pack set 300 includes an ink pack 310 and the memory unit 100, which are packaged together therein. For example, the black ink pack set 300 includes the ink pack 310 accommodating a black ink and the memory unit 100 storing black ink color information, which are packaged together therein. In the ink pack 310, ink is filled in a bag (pouch pack) that is formed of, for example, a laminated film.

According to the printing apparatus 200 of the present embodiment, a user can continue printing by replenishing ink in the ink tank 220 in the case of a lack of ink within the ink tank 220.

Figure 7:
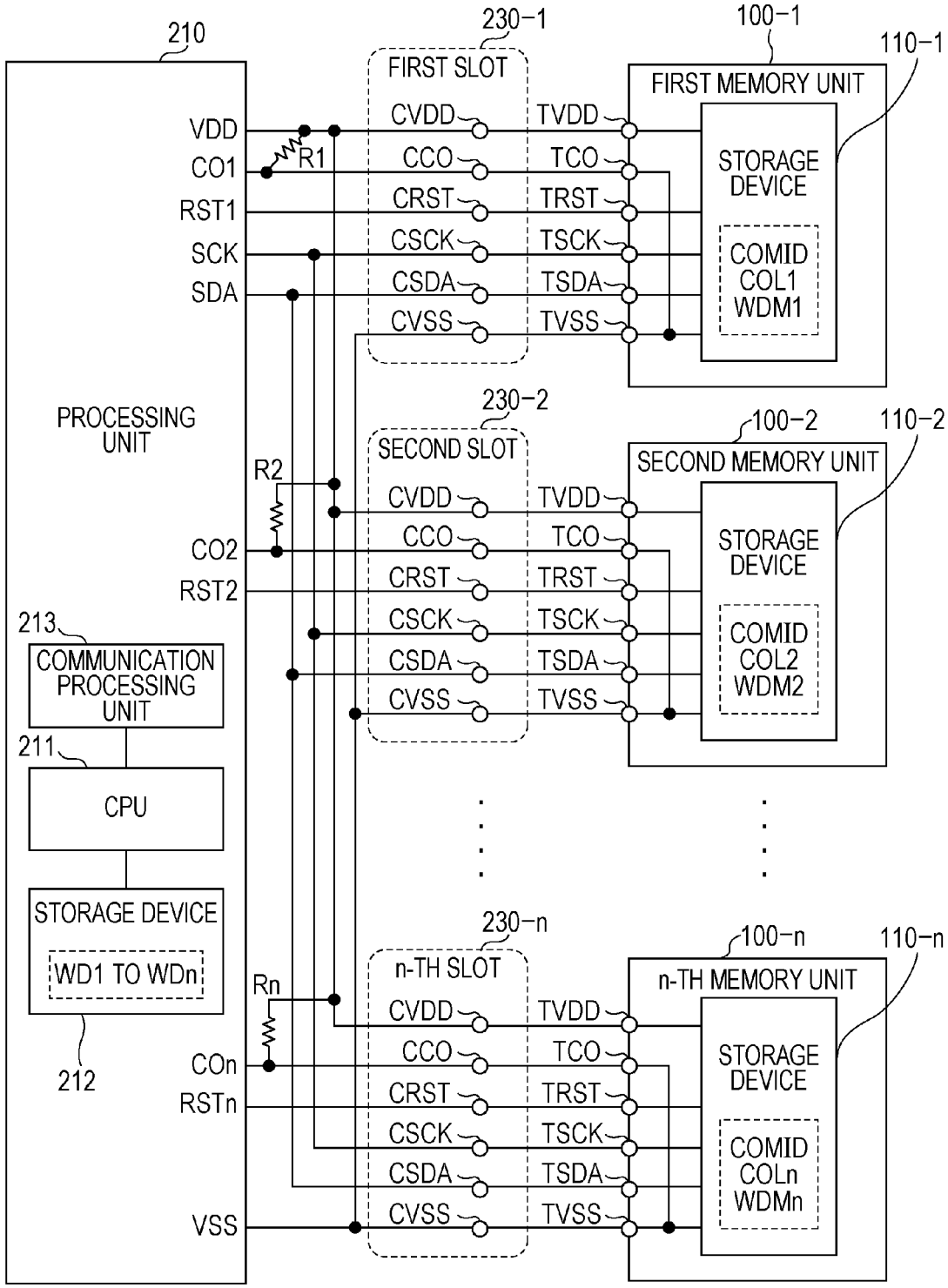
FIG. 7 illustrates a configuration example of first to n-th slots, first to n-th memory units, and a processing unit.

FIG. 7 illustrates a configuration example of the first to n-th slots 230-1 to **230-*n*, the first to n-th memory units 100-1 to 100-*n*, and the processing unit 210 of the printing apparatus 200 of the present embodiment. Meanwhile, the printing apparatus 200 of the present embodiment is not limited to the configuration shown in FIG. 7**, and various modifications such as omission of some of its components, replacement with other components, or the addition of other components can be made.

Each of the first to n-th memory units 100-1 to **100-*n* includes the reset terminal TRST, the clock terminal TSCK, the data terminal TSDA, the first power terminal TVDD, and the second power terminal TVSS, as storage device terminals. These storage device terminals are electrically connected to the storage device 110 that is included in each memory unit 100**.

In addition, each of the first to n-th memory units 100-1 to **100-*n* includes the installation detection terminal TCO. In each memory unit 100**, the installation detection terminal TCO is electrically connected to the second power terminal TVSS.

Each of the first to n-th memory units 100-1 to **100-*n* includes the storage device 110. Common communication ID information COMID that does not depend on an ink color of the packaged ink pack 310, ink color information COL (COL1 to COLn) corresponding to the ink color of the packaged ink pack 310, and the initial amount of ink filled in the packaged ink pack are written in the storage device 110 when shipped from the factory. In addition, total ink consumption information WDM (WDM1 to WDMn) of the corresponding ink color is written by the processing unit 210 in the storage device 110, in association with the execution of the printing process. In addition, the storage device 110 includes a region for storing information indicating whether the use of the memory unit 100 is terminated. The storage device 110** can be constituted by a non-volatile memory such as an EEPROM.

The storage device terminals TRST, TSCK, TSDA, TVDD, and TVSS and the installation detection terminal TCO are electrically connected to the terminals on the main body side CRST, CSCK, CSDA, CVDD, CVSS, and CCO, respectively, which are provided in the first slot 230-1, by installing the first memory unit 100-1 in the first slot 230-1. The same is true of the second to n-th memory units 100-2 to **100-*n***.

In the terminals on the main body side which are provided in the first to n-th slots 230-1 to **230-*n*, the clock terminal CSCK, the data terminal CSDA, the first power terminal CVDD, and the second power terminal CVSS are commonly connected. The processing unit 210 outputs a clock signal SCK, a first power supply voltage (power supply voltage on the high-potential side) VDD, and a second power supply voltage (power supply voltage on the low-potential side) VSS to the clock terminal CSCK, the first power terminal CVDD, and the second power terminal CVSS, respectively. In addition, the processing unit 210** outputs a data signal SDA to the data terminal CSDA, and receives the data signal SDA from the data terminal CSDA.

The processing unit 210 outputs first to n-th reset release signals RST1 to RSTn to the reset terminals CRST that are provided in the first to n-th slots 230-1 to **230-*n***.

The processing unit 210 includes the CPU 211, the storage unit 212, and the communication processing unit 213, and executes a printing process of the printing apparatus 200, a process of counting the ink consumption, a communication process with each memory unit 100, and the like. The storage unit 212 stores the total ink consumption information on the main body side WD (WD1 to WDn) of each ink color.

The processing unit 210 can detect that the memory unit 100 is installed in the slot 230, using the installation detection terminal TCO. For example, when the detection of installation is performed on the first slot 230-1, the processing unit 210 outputs the first power supply voltage VDD to the first power terminal CVDD and detects whether the memory unit is installed, on the basis of a voltage level of the first installation detection signal CO1. The installation detection terminal on the main body side CCO of the first slot 230-1 is connected to the first power terminal CVDD through a resistance element R1, and thus the voltage level of the first installation detection signal CO1 is set to an H level (a high-potential level, a VDD level) when the memory unit 100 is not installed.

On the other hand, when the memory unit 100 is installed, the installation detection terminal on the main body side CCO, and the installation detection terminal TCO and the second power terminal TVSS of the memory unit 100 are electrically connected to each other, and thus the voltage level of the first installation detection signal CO1 is set to a L level (a low-potential level, a VSS level). Therefore, the processing unit 210 can determine that the memory unit is not installed when the first installation detection signal CO1 is in an H level, and can determine that the memory unit is installed when the first installation detection signal is in a L level. In this manner, the processing unit 210 can detect whether the memory unit 100 is installed in each of the first to n-th slots 230-1 to **230-*n***.

A method of detecting the installation of the memory unit 100 is not limited to that illustrated in FIG. 7. For example, the installation of the memory unit may be detected by providing two installation detection terminals electrically connected to each other in the memory unit 100 and causing the processing unit 210 to detect electrical conduction between two installation detection terminals on the main body side (on the slot side) corresponding to the two installation detection terminals.

In the configuration example illustrated in FIG. 7, the processing unit 210 sets one of the first to n-th reset release signals RST1 to RSTn to be in an active state, and thus the processing unit can select one memory unit 100 so as to perform read-out or writing. However, a method of selecting the memory unit 100 is not limited thereto. For example, when the processing unit 210 is configured to individually output the clock signal SCK to each slot 230, the j-th memory unit **100-*j* can be selected by outputting the clock signal SCK to only the j-th memory unit 100-*j*. Alternatively, when the processing unit 210 is configured to individually input and output the data signal SDA to each slot 230, the j-th memory unit 100-*j* can also be selected by outputting the data signal SDA (for example, the read-out command) to only the j-th memory unit 100-*j***.

2. Total Ink Consumption

The processing unit 210 executes a process of counting ink consumption for each ink color during printing, and updates total ink consumption information on the main body side for each ink color on the basis of the counted ink consumption. The total ink consumption information on the main body side is stored in the storage unit 212 of the processing unit 210. The processing unit writes total ink consumption WD based on the total ink consumption information on the main body side, with respect to the storage device 110 of the memory unit 100 corresponding to the ink color in the first to n-th memory units 100-1 to **100-*n*, every time an amount of increase ΔWD in the total ink consumption WD based on the total ink consumption information on the main body side exceeds a first threshold value WTH1. Here, the amount of increase ΔWD in the total ink consumption WD is an amount of increase from the previous total ink consumption WD that is written in the storage device 110 by the processing unit 210. In this manner, a write process may be executed with respect to the storage device 110 every time the total ink consumption WD increases by the first threshold value WTH1, and thus the number of write processes can be suppressed. As a result, it is possible to suppress the destruction of stored data due to a write error of the storage device 110. In addition, since a difference between total ink consumption WDM written in the storage device 110** and the total ink consumption WD on the main body side can be set to equal to or less than the first threshold value WTH1, the total ink consumption can be managed with high reliability.

Further, the processing unit 210 writes the total ink consumption WD in the storage device 110 of the memory unit 100 when the total ink consumption WD exceeds a second threshold value WTH2 for defining the termination of use of the memory unit 100 even in a case where the amount of increase ΔWD in the total ink consumption WD does not exceed the first threshold value WTH1, and writes use termination information indicating that the use of the memory unit 100 is terminated, in the storage device 110. In this manner, since the total ink consumption WD and the use termination information can be written in the storage device 110 immediately after the total ink consumption WD exceeds the second threshold value WTH2, the use of the memory unit 100 can be reliably terminated. The processing unit 210 does not write the total ink consumption WD with respect to the storage device 110 in which the use termination information is written.

The first threshold value WTH1 is a value that is greater than a minimum value of ink consumption capable of being counted by the processing unit 210 and that is smaller than a second threshold value WTH2. For example, when the second threshold value WTH2 is 100%, the first threshold value WTH1 is 1%.

Figure 8:
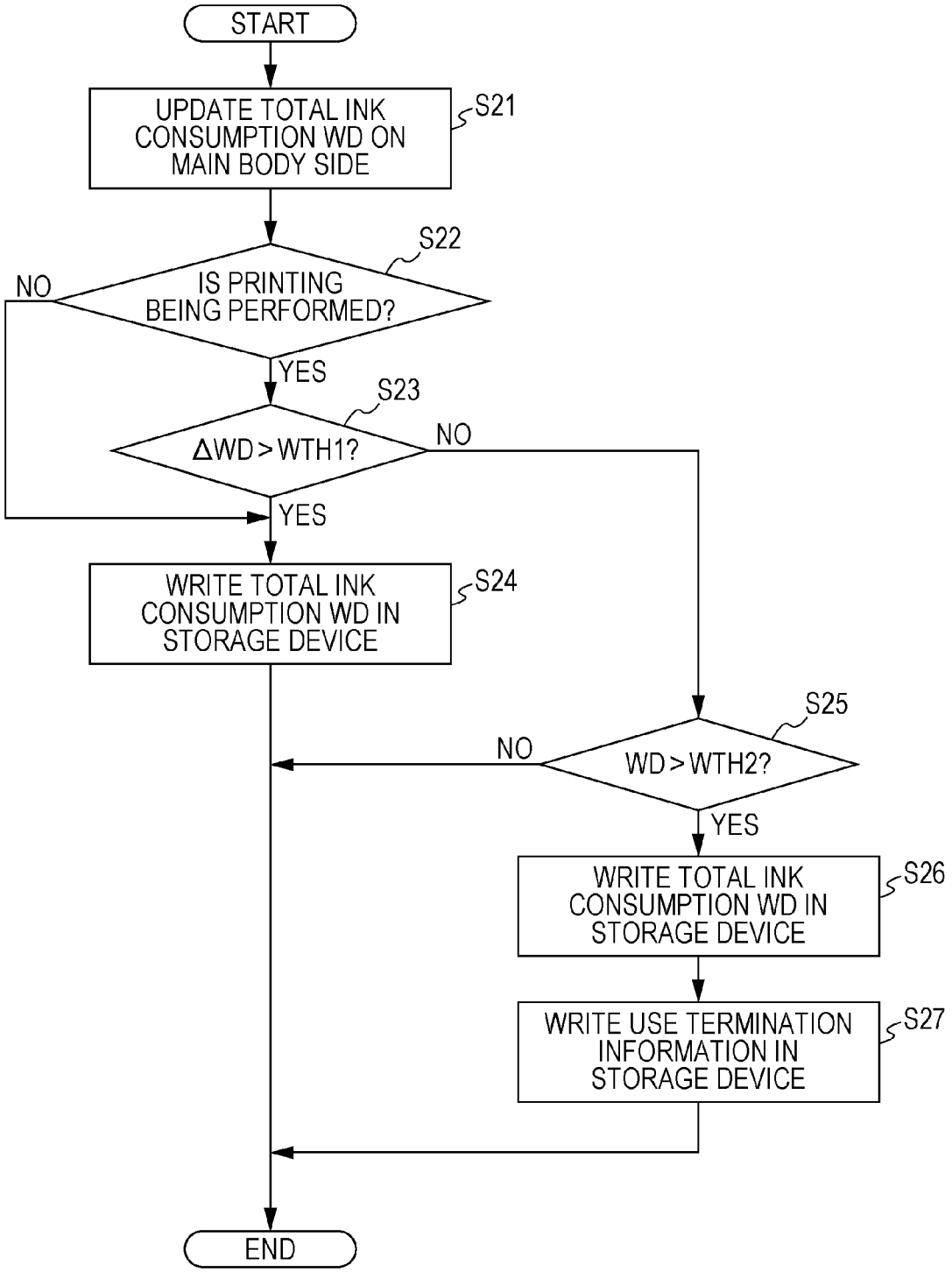
FIG. 8 is a flow chart illustrating an example of a process of writing total ink consumption in a storage device.

FIG. 8 is a flow chart illustrating an example of a process of writing the total ink consumption WD in the storage device 110. The process illustrated in the flow chart of FIG. 8 is executed by the processing unit 210.

The processing unit 210 executes a process of counting the ink consumption for each ink color, and updates the total ink consumption WD on the main body side for each ink color on the basis of the counted ink consumption (step S21). Subsequently, the processing unit 210 determines whether the printing is being performed (step S22), and determines whether the amount of increase ΔWD in the total ink consumption WD is greater than the first threshold value WTH1 when the printing is being performed (step S23). On the other hand, when the printing is not being performed, the processing unit writes the total ink consumption WD in the storage device 110 (step S24).

In step S23, when the amount of increase ΔWD is greater than the first threshold value WTH1, the processing unit 210 writes the total ink consumption WD in the storage device 110 (step S24). On the other hand, when the amount of increase ΔWD is equal to or less than the first threshold value WTH1, the processing unit determines whether the total ink consumption WD is greater than the second threshold value WTH2 (step S25).

In step S25, when the total ink consumption WD is greater than the second threshold value WTH2, the processing unit writes the total ink consumption WD in the storage device 110 (step S26), and further writes the use termination information (step S27). On the other hand, when the total ink consumption WD is equal to or less than the second threshold value WTH2, the processing unit terminates the process without performing writing.

The total ink consumption can be expressed by a relative value (0 to 100%), for example, when an amount of ink accommodated in the ink pack 310 is set to 100%. The processing unit 210 reads out an initial filling amount of the ink pack 310 from the memory unit 100, and calculates the relative value from the filling amount of the ink pack and the amount of ink consumed. However, in an actual printing apparatus, ink consumption efficiency (printing efficiency) varies. That is, even though a printing process is executed using the same printing data, the ink consumption is not equal, and a printing apparatus with a high ink consumption or a printing apparatus with a low ink consumption is present.

Consequently, when the ink consumption efficiency of the printing apparatus 200 in which the memory unit 100 is installed is a lower limit within a predetermined range, a value corresponding to the total ink consumption WD that is estimated when ink corresponding to an amount of ink accommodated in the ink pack 310, which is packaged together with the memory unit 100, is consumed, is set to be the second threshold value WTH2. The total ink consumption WD is expressed by a relative value (0 to 100%) by setting the second threshold value WTH2 to 100%.

The printing apparatus 200 with ink consumption efficiency which is a lower limit within a predetermined range is, for example, a printing apparatus having the lowest ink consumption efficiency in printing apparatuses that are shipped from the factory. Even in a case where the printing apparatus 200 is used, the printing can be performed until the total ink consumption WD reaches the second threshold value WTH2 (100%). In addition, when the total ink consumption WD reaches the second threshold value WTH2, the processing unit 210 can execute a process of displaying a message or the like for prompting a user to replenish ink, and thus the user can replenish the ink before the ink remaining in the ink tank 220 is all consumed.

On the other hand, in a case where the printing apparatus 200 having the highest ink consumption efficiency is used, ink still remains in the ink tank 220 at the time the total ink consumption WD reaches the second threshold value WTH2 (100%), and thus the printing can be performed until the total ink consumption WD reaches, for example, 135%.

When the total ink consumption WD is equal to or greater than 0 and less than 100%, the processing unit 210 executes a process of writing the total ink consumption WD in the storage device 110 of the memory unit 100 during the printing, as described above on condition that the memory unit 100 is installed in the slot 230 corresponding to the ink color and the use termination information is not written in the storage device 110 of the installed memory unit 100. Therefore, the processing unit 210 does not execute printing in a case where the memory unit 100 corresponding to the ink color is not installed or in a case where the use termination information is written in the storage device 110 of the memory unit 100 corresponding to the ink color, when the total ink consumption WD based on the total ink consumption information on the main body side is less than the second threshold value WTH2.

The processing unit 210 sets the printing to be in an executable state even in a case where the memory unit 100 corresponding to the ink color is not installed or even in a case where the use termination information is written in the storage device 110 of the memory unit 100 corresponding to the ink color, when the total ink consumption WD based on the total ink consumption information on the main body side is equal to or greater than the second threshold value WTH2 and less than a third threshold value WTH3. Here, the third threshold value WTH3 is a value corresponding to the total ink consumption WD that is estimated when ink corresponding to an amount of ink accommodated in the ink pack 310, which is packaged together with the memory unit 100, is consumed, in a case where the ink consumption efficiency is an upper limit within a predetermined range. Specifically, the third threshold value is a value (for example, 135%) corresponding to the total ink consumption WD that is estimated when ink corresponding to an amount of ink accommodated in the ink pack 310, is consumed, in a case where the printing apparatus 200 with the highest ink consumption efficiency is used. In this manner, when ink remains in the ink tank 220 even though the total ink consumption WD is equal to or greater than the second threshold value WTH2 (100%), the printing can be continued using the remaining ink.

In the actual printing apparatus 200, the remaining ink is sometimes all consumed before the total ink consumption WD reaches the third threshold value WTH3. However, the ink tank 220 is provided with an ink end sensor for detecting that the ink within the ink tank 220 is all consumed, and the processing unit 210 can stop the printing on the basis of detection of an ink end through the ink end sensor.

FIG. 9A is a diagram illustrating conditions for executing printing in the printing apparatus 200 of the present embodiment. FIG. 9A illustrates the presence or absence of ink within the ink tank, the total ink consumption WD on the main body side, installation/non-installation of the memory unit 100, and the presence or absence of use termination information, as conditions.

When ink is not present within the ink tank (when the ink end sensor of the ink tank 220 detects that ink is not present), printing cannot always be executed. A case where ink is present within the ink tank will be described below.

When the total ink consumption WD on the main body side is less than the second threshold value WTH2, the printing can be performed only when the memory unit 100 in which the use termination information is not written is installed. When the total ink consumption WD on the main body side is equal to or greater than the second threshold value WTH2 and less than the third threshold value WTH3, the printing can be performed, irrespective of the installation/non-installation of the memory unit 100 and the presence or absence of the use termination information. When the total ink consumption WD on the main body side is equal to or greater than the third threshold value WTH3, the printing cannot be performed.

In this manner, according to the printing apparatus 200 of the present embodiment, even in a case of a printing apparatus having the lowest ink consumption efficiency, a user can execute printing with an easy mind without caring about the amount of remaining ink until the total ink consumption reaches the second threshold value WTH2. Since the message for prompting the user to replenish ink is displayed at the time the total ink consumption reaches the second threshold value WTH2, the user can replenish the ink in the ink tank 220 from the ink pack 310 and can replace the memory unit 100 in which use termination information is written with a new (an initial state) memory unit 100 (use termination information is not written, and ink consumption count is 0%).

Further, according to the printing apparatus 200 of the present embodiment, in a case where ink remains in the ink tank 220 at the time the total ink consumption reaches the second threshold value WTH2, the printing can be continued without any change. A user can replenish ink and replace the memory unit 100 by determining a time to replenish ink. In addition, since the printing can be performed even though the memory unit 100 is not installed when the total ink consumption WD is equal to or greater than the second threshold value WTH2 and less than the third threshold value WTH3, it is possible to replenish ink and replace the memory unit 100 without stopping the printing in a case of, for example, a time-consuming printing. Alternatively, the printing can be continued by only replenishing ink without replacing the memory unit 100.

When the total ink consumption WDM written in the storage device 110 of the memory unit 100 is less than the second threshold value WTH2 after power is applied to the printing apparatus 200 or after any one of the first to n-th memory units 100-1 to **100-*n* is replaced, the processing unit 210 rewrites the total ink consumption information on the main body side to the same value as the total ink consumption WDM that is written in the storage device 110 of the memory unit 100. In this manner, the total ink consumption WDM written in the storage device 110 and the total ink consumption WD on the main body side can be set to have the same value. In addition, when ink is replenished and the memory unit 100** is replaced, the total ink consumption information on the main body side can be rewritten to an initial value (0%).

On the other hand, when the total ink consumption WDM written in the storage device 110 of the memory unit 100 is equal to or greater than the second threshold value WTH2, the use of the storage device 110 is terminated as described above. Therefore, the total ink consumption WDM written in the storage device 110 is different from the actual total ink consumption WD. For this reason, in this case, the processing unit 210 does not rewrite the total ink consumption information on the main body side.

Further, when the memory unit 100 is installed in the slot 230 corresponding to the ink color of the ink that is accommodated in the packaged ink pack 310 in the first to n-th slots 230-1 to **230-*n*, the processing unit 210 rewrites the total ink consumption information on the main body side to the same value as the total ink consumption WDM written in the storage device 110 of the memory unit 100. In this manner, it is possible to prevent the total ink consumption information on the main body side from being written to an erroneous value when the memory unit 100 is erroneously installed in the slot 230 corresponding to the ink tank 220** of a different color.

Specifically, the processing unit 210 outputs a read-out command to the memory unit 100, and determines whether the ink color information COL that is read out by the read-out command and the ink color corresponding to the slot 230 in which the memory unit 100 is installed are consistent with each other. When the read-out ink color information COL and the ink color corresponding to the slot 230 are consistent with each other, the processing unit determines that the memory unit 100 is correctly installed, and thus rewrites the total ink consumption information on the main body side. On the other hand, when both are not consistent with each other, the processing unit determines that the memory unit 100 is erroneously installed, and thus does not rewrite the total ink consumption information on the main body side.

FIG. 9B is a diagram illustrating conditions for rewriting total ink consumption information on the main body side. FIG. 9B illustrates total ink consumption WDM on the memory side and erroneous installation of the memory unit 100 as conditions.

When the total ink consumption WDM on the memory side is less than the second threshold value WTH2, the processing unit 210 rewrites the total ink consumption information on the main body side only when the memory unit 100 is correctly installed. On the other hand, when the total ink consumption WDM on the memory side is equal to or greater than the second threshold value WTH2, the processing unit 210 does not rewrite the total ink consumption information on the main body side. In addition, the processing unit does not rewrite when the use termination information of the memory unit 100 is written in the storage device 110 even though the total ink consumption WDM on the memory side is less than the second threshold value WTH2.

3. Detection of Erroneous Installation of Memory Unit

There is a concern that a user may erroneously install the memory unit 100 in the slot 230 corresponding to a different ink color when the user installs the memory unit in the slot 230. When the memory unit 100 is erroneously installed, the printing apparatus 200 cannot execute a correct printing process.

Consequently, in the printing apparatus 200 of the present embodiment, the processing unit 210 reads out ink color information from the storage device 110 of the memory unit 100 that is installed in each slot 230, and determines whether the read-out ink color information and an ink color corresponding to the slot 230 are consistent with each other, in advance of the execution of the printing process. When the read-out ink color information and the ink color corresponding to the slot 230 are inconsistent with each other, the processing unit determines that the memory unit 100 is erroneously installed. When the processing unit 210 determines that the memory unit is erroneously installed, the processing unit executes a process of displaying an error message or the like. In this manner, it is possible to prevent the printing process from being executed in a state where the memory unit 100 is erroneously installed.

Figure 10:
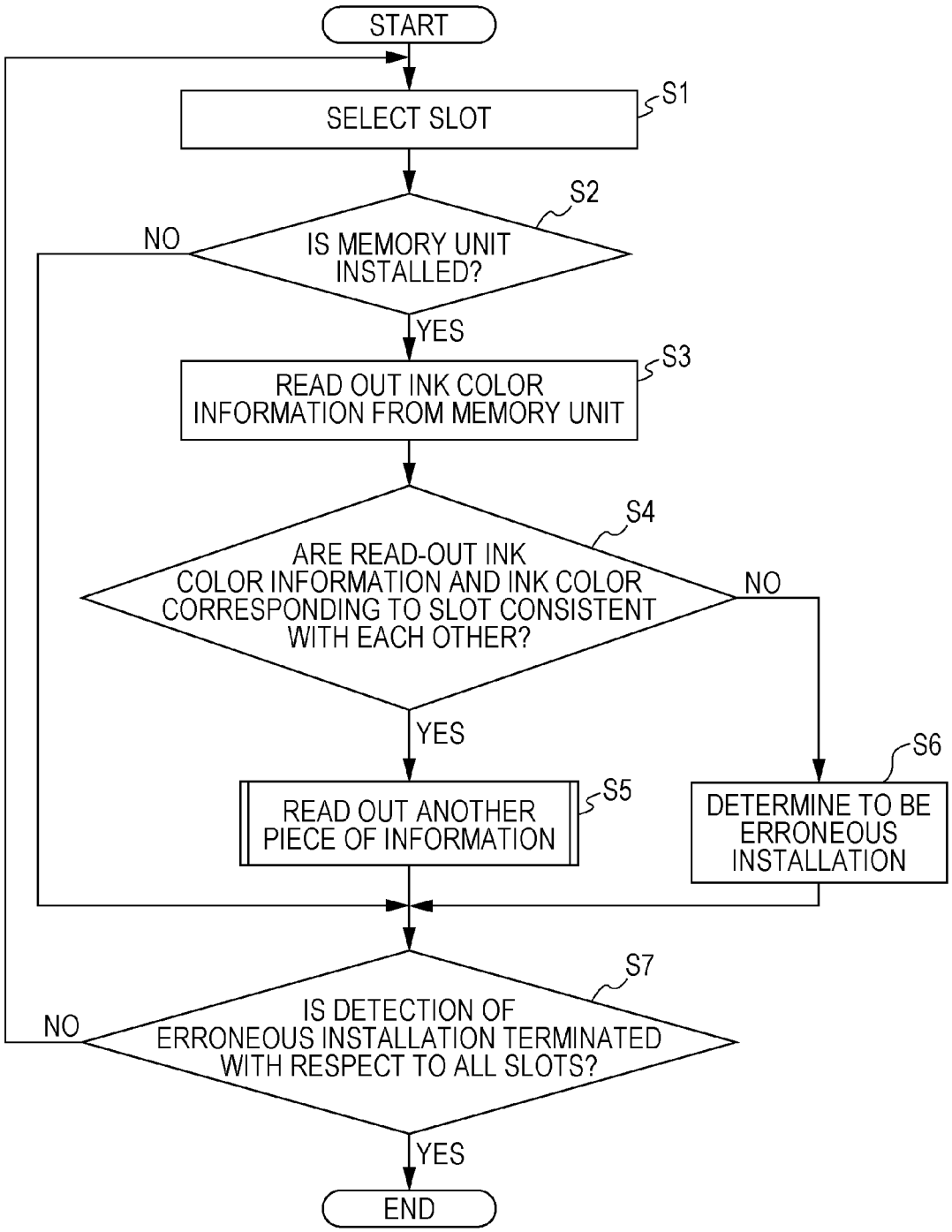
FIG. 10 is a flow chart illustrating an example of a process of detecting erroneous installation of the memory unit.

FIG. 10 is a flow chart illustrating an example of a process of detecting the erroneous installation of the memory unit 100 in the printing apparatus 200 of the present embodiment. A flow illustrated in FIG. 10 is executed by the processing unit 210.

In a first step S1, the processing unit 210 selects one slot 230 which is an object of erroneous installation. Specifically, the processing unit selects, for example, the first slot 230-1.

Subsequently, the processing unit 210 determines whether the memory unit 100 is installed in the selected slot (for example, the first slot 230-1) (step S2). Specifically, as described above, it is possible to detect whether the memory unit is installed, using the installation detection terminal CCO of the selected slot. When the memory unit 100 is installed in the selected slot, the process proceeds to step S3. On the other hand, when the memory unit is not installed in the selected slot, the process proceeds to step S7 without executing a read-out process.

In step S3, the processing unit 210 reads out the ink color information from the memory unit 100. Specifically, the processing unit outputs a read-out command to the memory unit 100 that is installed in the selected slot 230, and reads out the ink color information COL that is stored in the storage device 110 of the memory unit 100. The read-out process will be described below in detail.

Subsequently, the processing unit 210 determines whether the read-out ink color information COL and the ink color corresponding to the selected slot 230 are consistent with each other (step S4). For example, when the first slot 230-1 corresponding to black is selected, if the read-out ink color information COL is black, it is determined that both are consistent with each other. On the other hand, when the read-out ink color information COL is yellow, it is determined that both are inconsistent with each other. When both are consistent with each other, the processing unit 210 determines that the memory unit 100 is correctly installed, and thus the process proceeds to step S5. When both are inconsistent with each other, the processing unit 210 determines that the memory unit 100 is erroneously installed, and thus the processing unit displays an error message or the like for notifying the erroneous installation to a user.

When the memory unit 100 is correctly installed, the processing unit 210 reads out other pieces of information (for example, total ink consumption information WDM, unique ID information, use history information, and the like) from the storage device 110 of the memory unit 100 (step S5).

Subsequently, the processing unit 210 determines whether the detection of erroneous installation is terminated with respect to all the slots 230-1 to **230-*n* (step S7). When the detection of erroneous installation is not terminated with respect to all the slots 230-1 to 230-*n*, the process returns to step S1 to select the next slot (for example, the second slot 230-2), and the process of step S2 and the subsequent processes are repeated. When the detection of erroneous installation is terminated with respect to all the slots 230-1 to 230-*n***, the process is terminated.

4. Read-Out Process with Respect to Storage Device

The processing unit 210 selects the j-th (j is an integer satisfying the relation of $1 \leq j \leq n$) slot **230-*j* in the first to n-th slots 230-1 to 230-*n*, and outputs a read-out command including the communication ID information COMID, to the storage device 110 included in the j-th memory unit 100-*j* that is installed in the selected j-th slot 230-*j*. Specifically, the processing unit 210 outputs a predetermined signal to the storage device terminals of the j-th memory unit 100-*j* that is installed in the selected j-th slot 230-*j* so as to set the storage device 110 of the j-th memory unit 100-*j* to be in a communicable state. The processing unit then outputs the read-out command including the communication ID information COMID, to the storage device 110 that is set to be in a communicable state. More specifically, the processing unit 210 outputs a reset release signal RSTj as a predetermined signal, to the reset terminal TRST of the selected j-th memory unit 100-*j*, so as to set the storage device 110 of the j-th memory unit 100-*j*** to be in a communicable state.

For example, when the first slot 230-1 is selected, the processing unit 210 sets the first reset release signal RST1 to be in an active state, and thus the storage device 110 of the first memory unit 100-1 is set to be in a communicable state. Similarly, when the second slot 230-2 is selected, the processing unit 210 sets the second reset release signal RST2 to be in an active state, and thus the storage device 110 of the second memory unit 100-2 is set to be in a communicable state. In this manner, the processing unit 210 can select one of the first to n-th memory units 100-1 to **100-*n* that are installed in the first to n-th slots 230-1 to 230-*n* and control read-out or writing with respect to the storage device 110 of the selected memory unit 100**.

Figure 11:
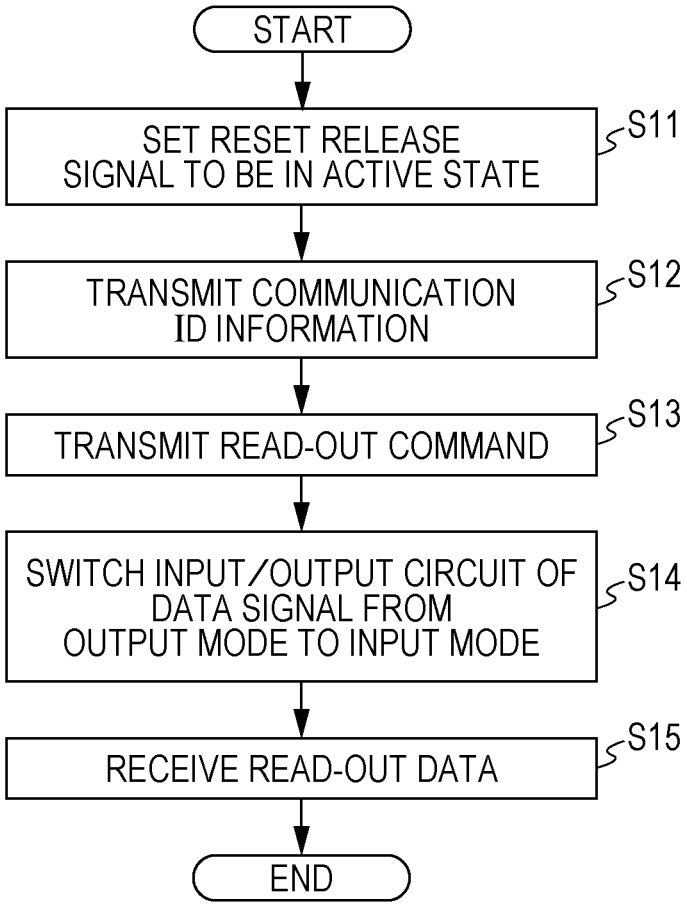
FIG. 11 is a flow chart illustrating an example of a read-out process with respect to the memory unit.

FIG. 11 is a flow chart illustrating an example of a read-out process with respect to the memory unit 100 in the printing apparatus 200 of the present embodiment. A flow illustrated in FIG. 11 illustrates the read-out process of step S3 of FIG. 10 in more detail, and is executed by the processing unit 210.

First, the processing unit 210 sets the reset release signal RST1 corresponding to a selected slot, for example, the first slot 230-1, to be in an active state (for example, an H level) (step S11). A reset state of the storage device 110 of the memory unit 100-1 that is installed in the first slot 230-1 is released and is set to be in a communicable state by setting the reset release signal RST1 to be in an active state.

Subsequently, the processing unit 210 transmits the communication ID information COMID as the data signal SDA, to the memory unit 100-1 (step S12). The communication ID information COMID is common communication ID information that does not depend on an ink color, and the same ID information is used with respect to the first to n-th memory units 100-1 to **100-*n***.

Next, the processing unit 210 transmits a read-out command as the data signal SDA, to the memory unit 100-1 (step S13). The storage device 110 of the memory unit 100-1 reads out, for example, the ink color information COL, in response to the received read-out command.

Subsequently, the processing unit 210 switches an input/output circuit of the data signal SDA from an output mode to an input mode (step S14). In this manner, the processing unit 210 can receive the data signal SDA from the memory unit 100-1.

Subsequently, the processing unit 210 receives read-out data (the ink color information COL) from the memory unit 100-1 (step S15), and then terminates the read-out process.

Figure 12:
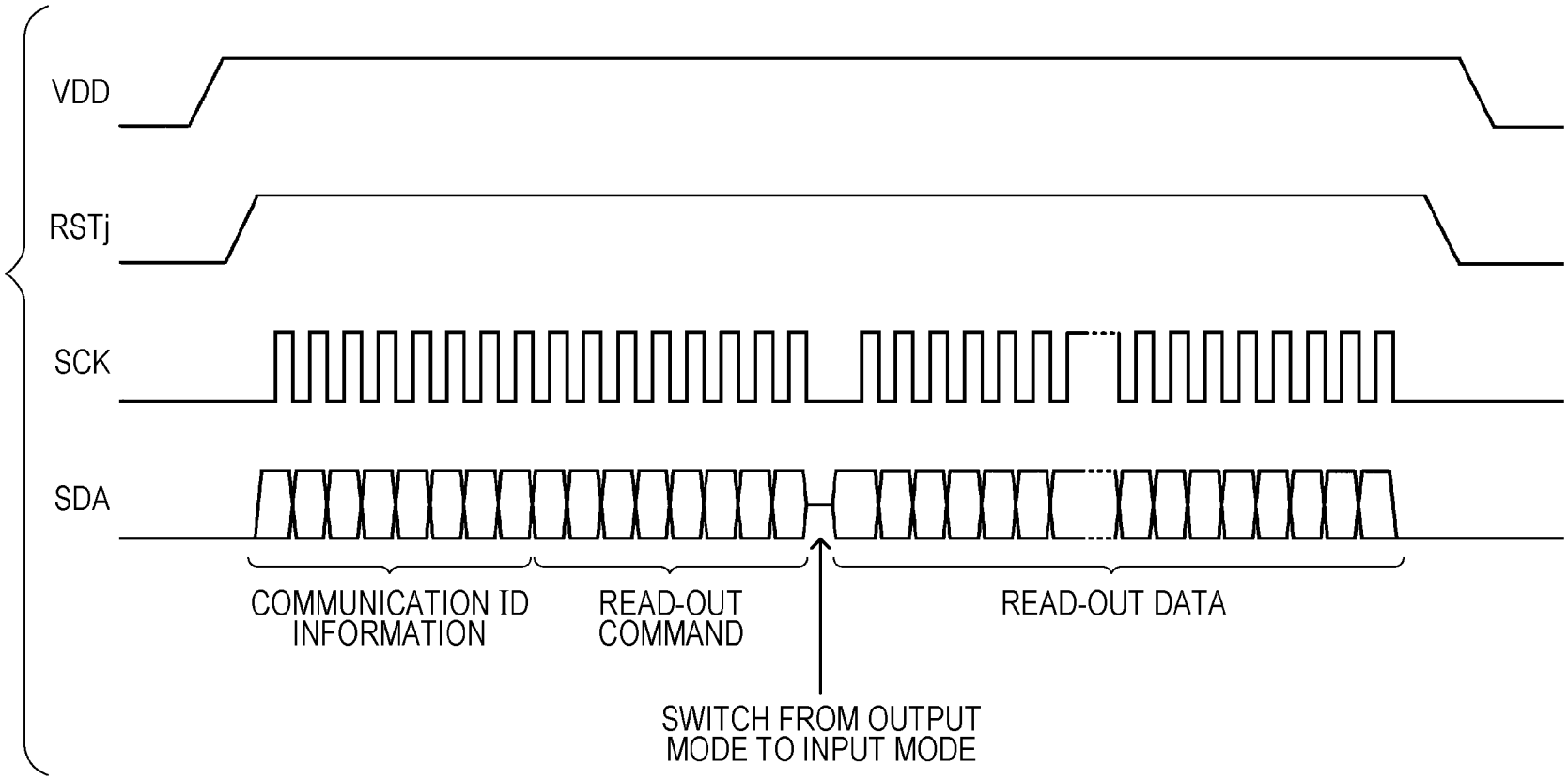
FIG. 12 is a timing chart illustrating an example of a read-out process with respect to a j-th memory unit.

FIG. 12 is a timing chart illustrating an example of a read-out process with respect to the j-th memory unit **100-*j*. FIG. 12** illustrates the first power supply voltage VDD, the j-th reset release signal RSTj, the clock signal SCK, and the data signal SDA.

After the first power supply voltage VDD rises to a predetermined voltage, the j-th reset release signal RSTj is set to be in an active level (an H level). In this manner, the reset state of the storage device 110 of the j-th memory unit 100-*j* is released, and thus the storage device is set to be in a communicable state. At this time, a reset state of the storage device 110 of another memory unit 100 is maintained.

The processing unit 210 outputs the clock signal SCK, and transmits the communication ID information COMID and the read-out command as the data signal SDA, in synchronization with the clock signal SCK. After transmitting the read-out command, the input/output circuit of the data signal SDA is switched from an output mode to an input mode. After the switching into the input mode, the processing unit 210 receives the read-out data from the j-th memory unit 100-*j*.

In FIG. 12, the communication ID information COMID and the read-out command are constituted by 8 bits, but may be constituted by a number of bits other than 8 bits.

The storage device 110 of the printing apparatus 200 of the present embodiment receives the communication ID information COMID that is transmitted by the processing unit 210, and compares the received communication ID information COMID with its own communication ID information COMID. When the two pieces of communication ID information COMID are consistent with each other, the storage device 110 subsequently decodes and executes the received read-out command. However, when the two pieces of communication ID information COMID are not consistent with each other, the storage device does not execute the read-out command.

In the printing apparatus 200 of the present embodiment, the storage device 110 stores common communication ID information that does not depend on an ink color, as communication ID information COMID. Therefore, the processing unit 210 can execute the read-out process by transmitting the same communication ID information COMID to each slot 230, that is, each memory unit 100, in the above-described process of detecting erroneous installation.

As described above, according to the printing apparatus 200 of the present embodiment, since a number of processes of writing the total ink consumption WD in the storage device 110 can be suppressed, the destruction of data due to a write error can be suppressed. In addition, a difference between the total ink consumption WDM written in the storage device 110 and the total ink consumption WD on the main body side can be set to be equal to or less than the first threshold value WTH1. Further, since the total ink consumption WD and use termination information can be written in the storage device 110 immediately after the total ink consumption WD exceeds the second threshold value WTH2, the use of the memory unit 100 can be reliably terminated.

In addition, according to the printing apparatus 200 of the present embodiment, when ink remains in the ink tank 220 even though the total ink consumption WD is equal to or greater than the second threshold value WTH2, the printing can be continued using the remaining ink. Alternatively, in a case of, for example, a time-consuming printing, the printing can be continued by replenishing ink without stopping the printing.

Further, according to the printing apparatus 200 of the present embodiment, the erroneous installation of the memory unit 100 is detected, and when the memory unit is not erroneously installed, the total ink consumption WD on the main body side can be rewritten to the same value as the total ink consumption WDM that is written in the storage device 110 of the memory unit 100. As a result, it is possible to prevent the total ink consumption WD on the main body side from being rewritten to an erroneous value.

In this manner, according to the printing apparatus 200 of the present embodiment, it is possible to realize total ink consumption management having a high convenience and a high reliability for a user.

Meanwhile, the present embodiment has been described above in detail, but it would have been obvious to one of ordinary skill in the art that various modifications can be made without substantially departing from the novel matter and effects of the invention. Therefore, all the modification examples are included within the scope of the invention. For example, in the specification or the drawings, terms that are described at least once together with different terms having a broader meaning or the same meaning can be replaced with the different terms in any place of the specification or the drawings. In addition, the configuration and operation of the printing apparatus is not limited to those described in the present embodiment, and can be implemented in various ways.

In the present embodiment, an ink pack in which ink is filled in a pouch pack has been described as an ink pack, but the ink pack is not limited thereto. The ink pack includes, for example, a bottle constituted by plastic or a container constituted by a flexible material.

The entire disclosure of Japanese Patent Application No. 2012-191098, filed Aug. 31, 2012 is expressly incorporated by reference herein.

What is claimed is:

1. A printing apparatus comprising:

a first ink tank to an n-th (n is an integer equal to or greater than 2) ink tank in which ink accommodated in an ink pack is fillable;

a first slot to an n-th slot that respectively correspond to the first ink tank to the n-th ink tank;

a first memory unit to an n-th memory unit, each of which is corresponding to the color of ink contained in the ink pack and are respectively installable in the first slot to the n-th slot; and a processing unit that controls read-out of data from or writing of data to the first memory unit to the n-th memory unit that are respectively installed in the first slot to the n-th slot, wherein each of the first memory unit to the n-th memory unit has a storage device, and wherein the processing unit executes a process of counting ink consumption for each ink color during the printing, updates total ink consumption information on the main body side for each ink color on the basis of the counted ink consumption, writes the total ink consumption based on the total ink consumption information on the main body side, to the storage device of the memory unit corresponding to the ink color in the first memory unit to the n-th memory unit, every time an amount of increase in the total ink consumption based on the total ink consumption information on the main body side exceeds a first threshold value, writes the total ink consumption in the storage device of the memory unit when the total ink consumption exceeds a second threshold value for defining the termination of use of the memory unit even in a case where the amount of increase in the total ink consumption does not exceed the first threshold value, and writes use termination information indicating that the use of the memory unit is terminated, in the storage device.

2. The printing apparatus according to claim 1, wherein the processing unit does not execute printing in a case where the memory unit corresponding to the ink color is not installed or in a case where the use termination information is written in the storage device of the memory unit corresponding to the ink color, when the total ink consumption based on the total ink consumption information on the main body side is less than the second threshold value.

3. The printing apparatus according to claim 1, wherein the processing unit sets the printing apparatus to be in an printing operable state even in a case where the memory unit corresponding to the ink color is not installed or in a case where the use termination information is written in the storage device of the memory unit corresponding to the ink color, when the total ink consumption based on the total ink consumption information on the main body side is equal to or greater than the second threshold value and less than a third threshold value.

4. The printing apparatus according to claim 1, wherein the second threshold value is a value corresponding to total ink consumption that is estimated when ink corresponding to an amount of ink accommodated in the ink pack, which is packaged together with the memory unit, is consumed, in a case where ink consumption efficiency of the printing apparatus in which the memory unit is installed is a lower limit within a predetermined range.

5. The printing apparatus according to claim 1, wherein the processing unit rewrites the total ink consumption information on the main body side to the same value as the total ink consumption that is written in the storage device of the memory unit, in a case where the total ink consumption written in the storage device of the memory unit is less than the second threshold value after power is applied to the printing apparatus or after any one of the first memory unit to the n-th memory unit is replaced.

6. The printing apparatus according to claim 5, wherein the processing unit does not rewrite the total ink consumption information on the main body side to the total ink consumption that is written in the storage device of the memory unit, in a case where the total ink consumption written in the storage device of the memory unit is equal to or greater than the second threshold value.

7. The printing apparatus according to claim 5, wherein the processing unit rewrites the total ink consumption information on the main body side to the same value as the total ink consumption written in the storage device of the memory unit, in a case where the memory unit is installed in the slot corresponding to the ink color of ink accommodated in the ink pack with which the memory unit is packaged.

8. The printing apparatus according to claim 7, wherein the storage device stores ink color information corresponding to the ink color of the ink pack with which the memory unit is packaged, and wherein the processing unit outputs a read-out command to the memory unit, determines whether ink color information that is read out on the basis of the read-out command and an ink color corresponding to the slot in which the memory unit is installed are consistent with each other, and rewrites the total ink consumption information on the main body side to the same value as the total ink consumption written in the storage device of the memory unit when the read-out ink color information and the ink color corresponding to the slot are consistent with each other.

9. The printing apparatus according to claim 1, wherein the first memory unit to an n-th memory unit that are packaged together with the ink pack.

* * * * *